US006001033A

United States Patent [19]

Tucker

[11] Patent Number: 6,001,033

[45] Date of Patent: Dec. 14, 1999

[54] PUTTING TRAINING METHOD

[76] Inventor: Daniel Patrick Tucker, 1933 Notre Dame Avenue, Winnipeg Manitoba, Canada, R3H 0S7

[21] Appl. No.: 09/219,513

[22] Filed: Dec. 23, 1998

Related U.S. Application Data

[60] Provisional application No. 60/094,159, Jul. 27, 1998.

[51] Int. Cl.[6] ..... A63B 69/36

[52] U.S. Cl. ..... 473/409; 473/171; 473/178; 473/180

[58] Field of Search ..... 473/174, 180, 473/409, 171, 178

[56] References Cited

U.S. PATENT DOCUMENTS 3,424,464 1/1969 Greenhouse ..... 473/180
3,659,856 5/1972 Fatur ..... 473/180
5,310,187 5/1994 Yamaguchi et al. ..... 473/180

*Primary Examiner*—George J. Marlo
*Attorney, Agent, or Firm*—A. Battison; M. Thrift

[57] ABSTRACT

A putting aid comprising two arms converging to an apex such that an acute angle is formed therebetween is herein described. The two arms have inner faces that include markings, such as a center stripe opposite the apex, that act to improve the visibility of the putting aid. Specifically, the putting aid is arranged to be positioned on a putting green such that the golf cup is between the two arms and the center stripe is approximately four inches behind the golf cup. The putting aid is then oriented such that the apex is opposite the direction of putting relative to the golf cup. The golfer then uses the center stripe as a target when aiming for the golf cup. As a result of this arrangement, the location of the golf cup is more visible and a golfer aiming for the center stripe will tend to putt harder, that is, so that the putt will travel approximately four inches further. The end result is a stronger and more accurate putt.

1 Claim, 3 Drawing Sheets

PUTTING TRAINING METHOD

This application claims benefit of provisional application 60/094,159, filed Jul. 27, 1998.

The present invention relates generally to the field of golf inventions. More specifically, the present invention relates to a putting aid.

BACKGROUND OF THE INVENTION

As any golfer will tell you, the quickest way to improve one's score is to improve one's putting. Specifically, it is often difficult to accurately estimate the distance between the ball and the cup. The end result is often that the golfer does not swing hard enough, resulting in a putt that stops short of the hole and adds strokes to the golfer's score. Clearly, a device is needed that improves the visibility of the cup, thereby allowing the golfer to better estimate the distance to the cup and adjust their putting stroke appropriately.

SUMMARY OF THE INVENTION

According to a first aspect of the invention, there is provided a putting aid for use with a golf cup mounted within the ground, said putting aid comprising:

two arms lying in a common plane such that the putting aid is substantially planar, said arms converging to an apex such that an acute angle is formed therebetween, said arms each having an inner face, said inner faces arranged so as to be more visible, said putting aid arranged to be placed on the ground such that the golf cup is between the arms, thereby improving the visibility of the golf cup during putting.

The arms may include supports extending downward from the arms such that the arms of the putting aid are supported above the ground.

The inner faces may include markings for improving visibility.

The apex may include a sleeve for inserting a golf flag therein such that the golf flag is supported by the putting aid.

According to a second aspect of the invention, there is provided a method of improving putting comprising:

providing a putting green with a golf cup;

providing a putting aid comprising:

two arms lying in a common plane such that the putting aid is substantially planar, said arms converging to an apex such that an acute angle is formed therebetween, said arms each having an inner face, said inner faces arranged so as to be more visible;

placing the putting aid on the putting green such that the golf cup is between the arms and the apex is opposite the direction of putting, so that the golf cup is more visible; and putting the golf ball towards the golf cup.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
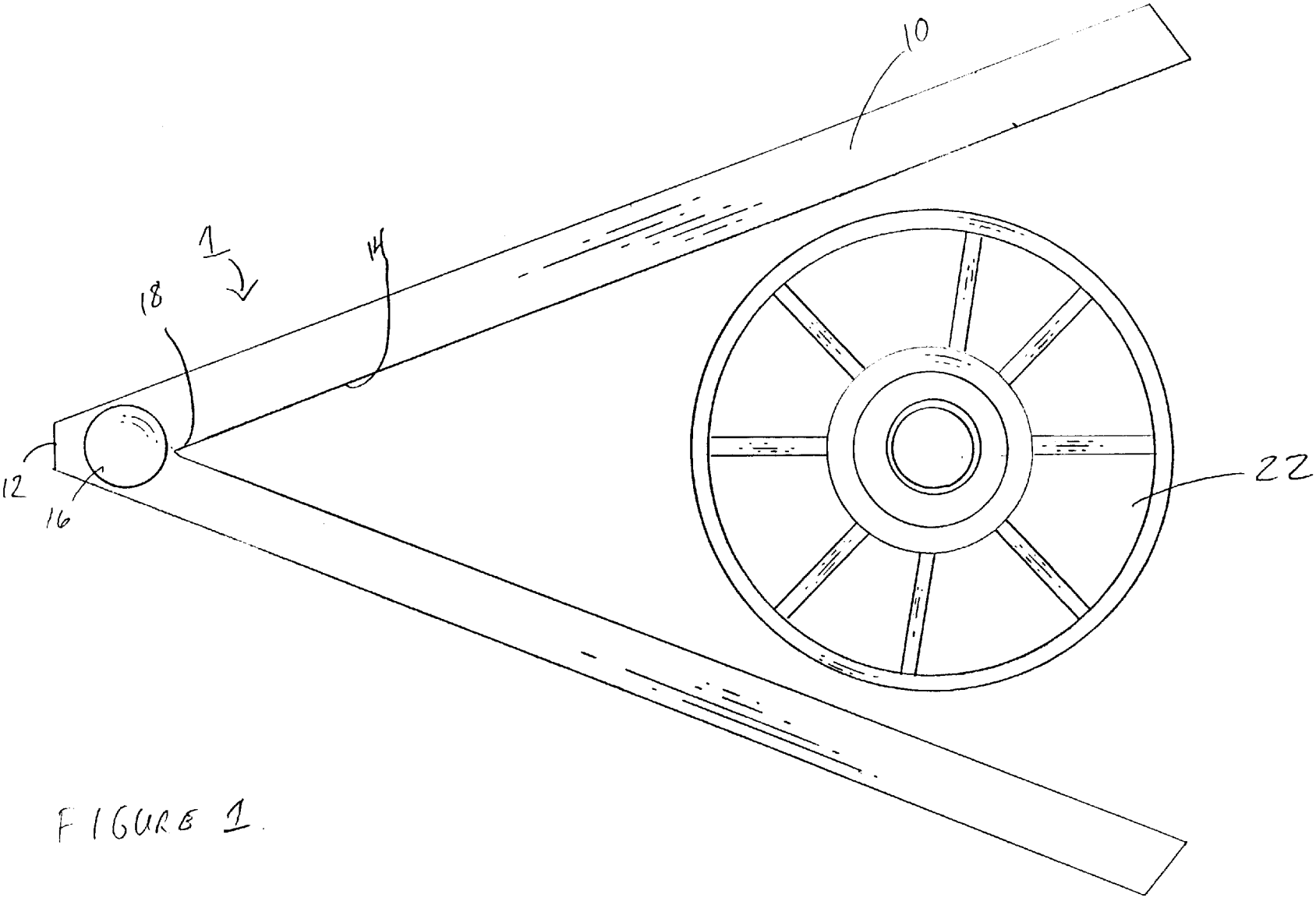
FIG. 1 is a top plan view of the putting aid.
Figure 2:
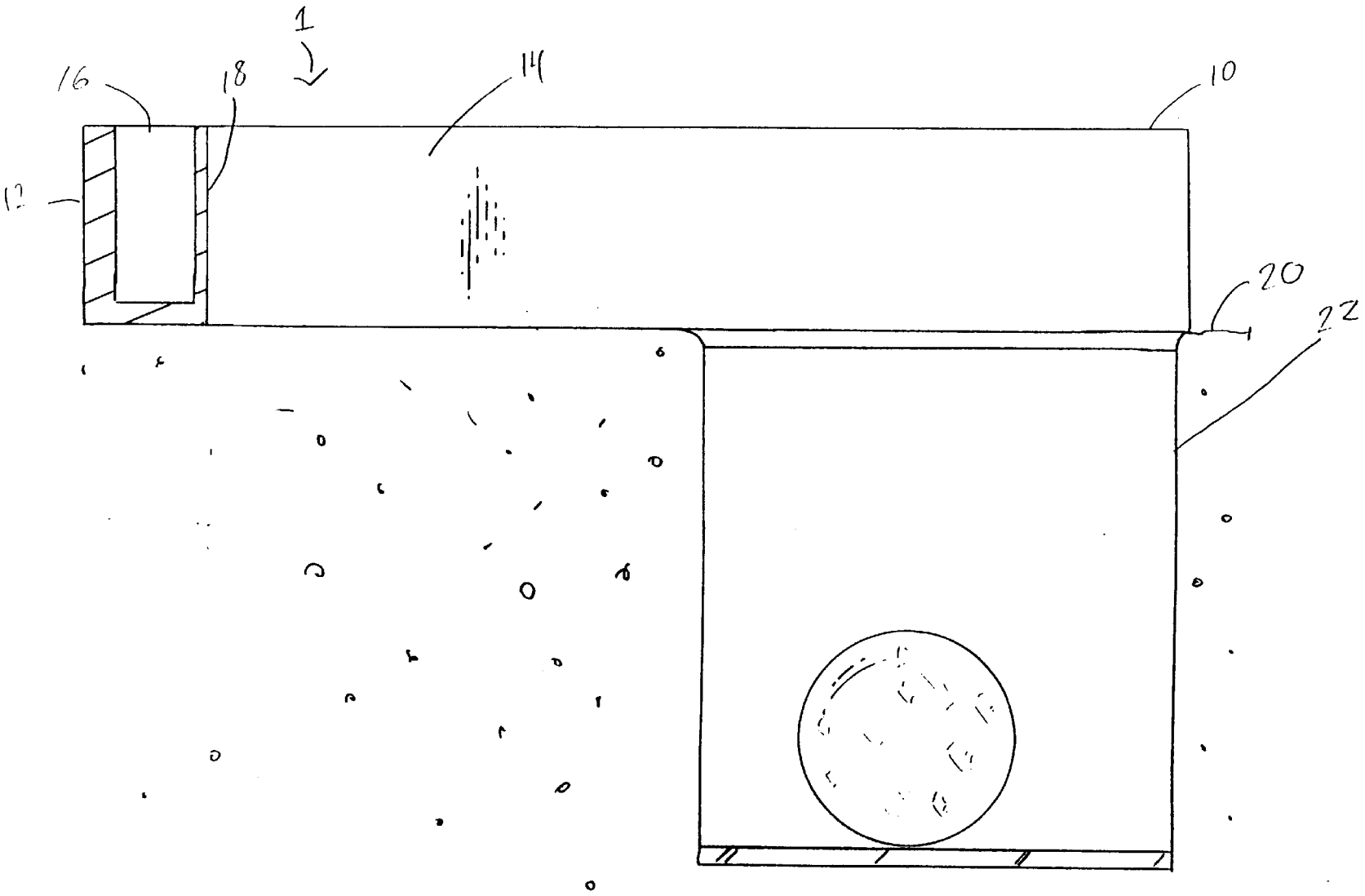
FIG. 2 is a side view in cross section of the putting aid.
Figure 3:
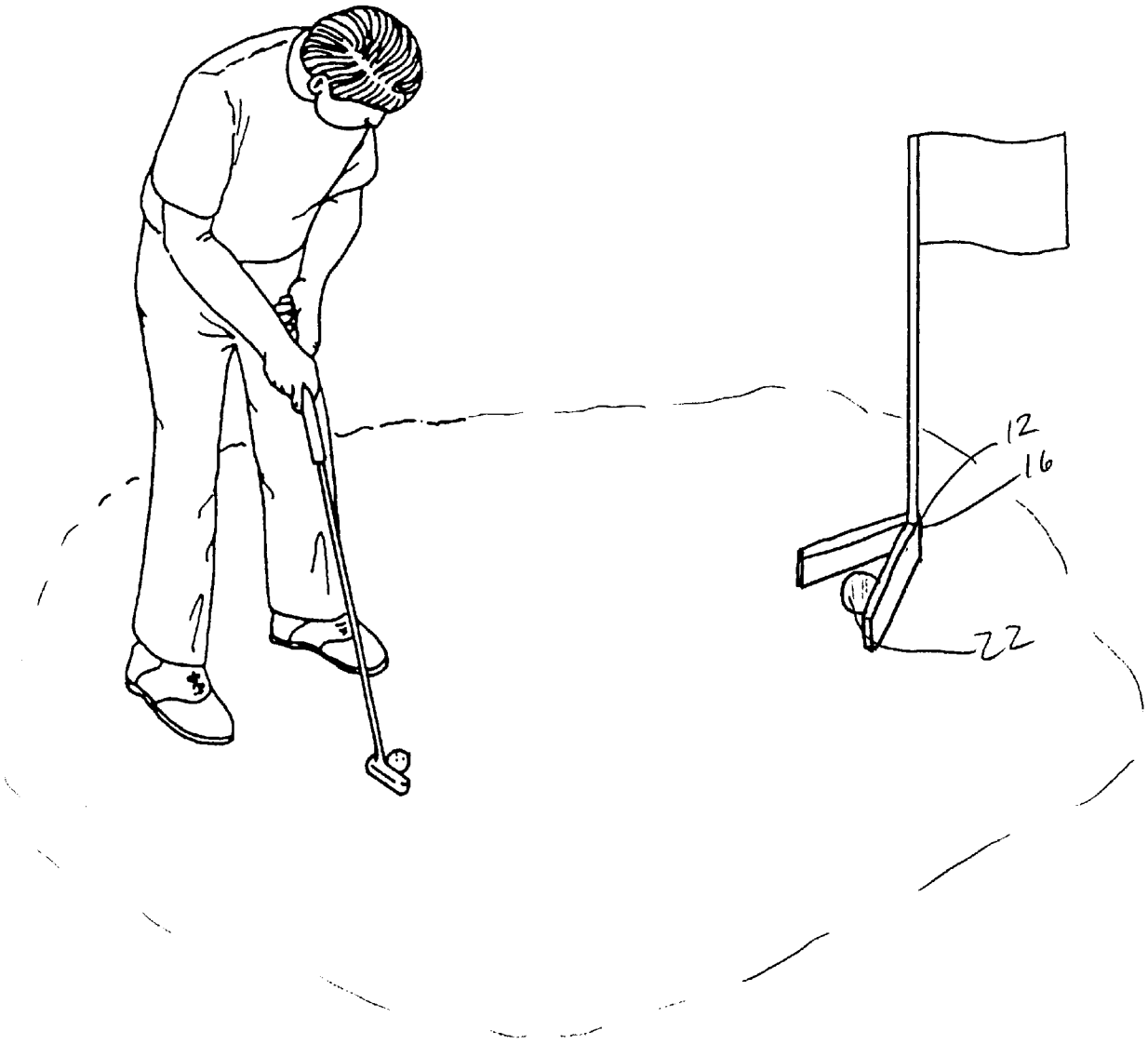
FIG. 3 is a diagram showing the putting aid in use.

Referring to the drawings, a putting aid 1 comprises two arms 10. Specifically, the two arms 10 lie in a common plane such that the putting aid is substantially planar, as shown in FIG. 2. The two arms 10 converge to an apex 12 such that an acute angle is formed therebetween, as shown in FIG. 1. Furthermore, the two arms 10 have inner faces 14 which are arranged to be more visible, as described below. In this embodiment, the putting aid 1 includes a centre stripe 18 on the inner faces 14 of the two arms opposite the apex 12, as shown in FIGS. 1 and 2.

In this embodiment, the putting aid 1 includes a sleeve 16 proximal to the apex 12, as shown in FIGS. 1 and 2. Specifically, the sleeve 12 is arranged to accept the shaft of a flagpole therein, as described below.

For use, the putting aid 1 is transported to a putting green 20 including a golf cup 22 and a flagpole (not shown). The putting aid 1 is then positioned on the putting green 20 such that the golf cup 22 is between the two arms 10 as shown in FIG. 1. Furthermore, the putting aid 1 is positioned on the putting green 20 such that the apex 12 is opposite the direction of the putt relative to the golf cup 22, as described below. That is, such that the centre stripe 18 is behind the golf cup 22 and provides a target for the putter, as described below. It is of note that, in this embodiment, the putting aid 1 is arranged such that the centre stripe 18 is approximately four inches behind the golf cup 22 when the putting aid 1 is positioned as described above.

For use, the putting aid 1 is aligned relative to the golf cup 22 such that the golf ball to be putted and the apex 16 of the putting aid 1 are on opposite sides of the golf cup 22. The golfer then aligns himself with the golf ball for putting and aims towards the golf cup 22. As discussed above, the putting aid 1 is positioned on the putting green 20 such that the golf cup 22 is between the two arms 10 and the centre stripe 18 is behind the golf cup 22. The golfer then uses the putting aid 1 as a target when aiming for the golf cup. As discussed above, in this embodiment, the centre stripe 18 is located approximately four inches behind the golf cup 22. As a result of this arrangement, the location of the golf cup 22 is more visible and a golfer aiming for the centre stripe 18 will tend to putt harder, that is, so that the putt will travel approximately four inches further. The end result is a stronger and more accurate putt.

The putting aid 1 may be composed of a plastics material or any suitable wood.

It is of note that the inner faces 14 of the arms of the putting aid 1 may be painted in various colours and may include markings for improving visibility. Specifically, the putting aid 1 may be black with a white or yellow stripe for use in the morning or early afternoon or the putting aid 1 may be yellow with a white or black stripe for use in the early evening or dusk.

In other embodiments, the putting aid 1 may include a handle for carrying the putting aid 1. The handle may be proximal to the apex 12 of the putting aid 1.

In other embodiments, the two arms 10 of the putting aid 1 may include supports arranged to depend downward from the two arms 10 such that the putting aid 1 is supported above the ground.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

I claim:

1. A method of improving putting comprising:

providing a putting green with a golf cup, said golf cup having a mouth;

providing a putting aid comprising:

two arms lying in a common plane, said arms converging to an apex such that an acute angle is formed therebetween;

placing the putting aid on the putting green such that the mouth of the golf cup is between the arms and the apex is behind the mouth of the golf cup relative to the golf ball, thereby providing a target for putting; and putting the golf ball towards the apex of the putting aid, wherein the putting aid is arranged such that the apex is behind the mouth of the golf cup relative to the golf ball and the arms extend wholly outside the mouth of the golf cup without contacting the mouth of the golf cup such that the mouth of the golf cup is open and uncovered, wherein the putting aid provides a target for putting positioned such that the mouth of the golf cup is uncovered, open and accessible to the golf ball.

* * * * *